United States Patent [19]

Wilson, Jr.

[11] Patent Number: 4,905,661

[45] Date of Patent: Mar. 6, 1990

[54] HEAT EXCHANGER

[76] Inventor: James C. Wilson, Jr., P.O. Box 1399, Hillsboro, N.H. 03244

[21] Appl. No.: 219,742

[22] Filed: Jul. 18, 1988

[51] Int. Cl.[4] ..... F24H 3/00

[52] U.S. Cl. ..... 126/99 A; 126/109; 126/99 D

[58] Field of Search ..... 126/99 A, 99 D, 390, 126/391, 392, 109

[56] References Cited

U.S. PATENT DOCUMENTS

| | | | |
|---|---|---|---|
| 2,053,037 | 9/1936 | Lintern | 126/99 D |
| 3,177,865 | 4/1965 | Jones et al. | 126/109 |
| 3,642,061 | 2/1972 | Waeselynck | 126/110 C X |

*Primary Examiner*—Larry Jones

*Attorney, Agent, or Firm*—George W. Dishong

[57] ABSTRACT

The present invention in its most simple form or embodiment is directed to a heat exchanger which provides for at least two heat exchange surfaces. The two heat exchange surfaces are defined by an inner wall or inner shell which separates a combustion region or combustion passage and at least one fluid passage defined by the inner shell, and an outer wall or outer shell. The space defined between the inner and outer shells being the combustion region or combustion passage. The combustion chamber is configured to provide for full and efficient fuel combustion without any flat surfaces upon which a flame of combustion could impinge. Because of the nature of the construction, the flame forms into a fan configuration allowing thorough mixture with the combustion air and thus providing for complete and efficient combustion.

10 Claims, 4 Drawing Sheets

HEAT EXCHANGER

BACKGROUND OF THE INVENTION

1. FIELD OF THE INVENTION

This invention most generally relates to a heat exchanging device for heating a fluid such as air and is more particularly concerned with providing heated air by conduction of heat from a combustion passage to a first fluid passage which is enveloped by the combustion passage and conduction of heat to a second fluid passage surrounding the combustion passage. The combustion passage is substantially coextensive withbut is not in air mixing communication with the two fluid passages. The gases of combustion travel substantially in a helical path through the combustion passage. Even more particularly the invention relates to a heat exchanging device for heating air wherein the combustion region is defined by two concentric cylindrically configured heat exchange surfaces and the combustion chamber has an arcuate surface upon which a flame strikes along chordal paths of a circle having centers along the center line of the cylindrical outer shell.

2. DESCRIPTION OF THE PRIOR ART

It would be desirable and advantageous to have a heat exchange device which would be capable of burning waste oil products efficiently and in a manner which would allow easy cleaning of the burner unit and the heat exchanger.It would also be desireable to have a unit or device which has the combustion take place within the heat exchanger instead of in a chamber removed from the heat exchange region. It is also important that the combustion flame not impinge directly onto a surface causing the deposition of deposits or the incomplete and inefficient burning of the fuel which may result. It is also important that the gases of combustion be kept separate and in a non mixing relationship and that these hot combustion gases be directed in such a manner as to encounter large surfaces which are in thermal contact which the medium, such as air or water, which is to be heated.

It would also be desirable to position the burner unit or device within the heat exchanger in such a manner that the residual heat within the combustion chamber and heat stored within the refractory does not radiate back toward the burner unit. That is it is important that after combustion ceases the location of the flame introducing means or system, such as the nozzle of an oil burner unit, be in a relatively cool location.

In order to be able to burn waste oil products in an efficient and ecologically sound manner, it is critical that the combustion efficiency be within well defined specifications. It is required that the efficiency be not less than 75% as measured according to industry accepted standards of testing and that the residuals emitted be as completely oxidized as possible at this efficiency level, in particular, the design of a device for the burning (rapid oxidation) of contaminated waste oils should have, for purposes of maximum overall efficiency i.e., maintenance labor, combustion, heat exchange, etc., a smooth uniform, constant, controlled flow of combusted gases throughout and there should be no abrupt direction changes prior to exhausting of the gases. This is necessary to uniformly deposit, within the device those noncombustibles inherently generated by this process. When this is accomplished the heat exchange degradation process is more nearly uniform preventing premature heat exchange loss in any given area. The instant invention accomplishes such an objective. Applicant is not aware of any heat exchanger devices or assemblies presently available which meet the necessary criteria for the proper and effective burning of waste oil products coupled with the ability to expose completely and in total all prime heating surfaces for necessary, periodical inspection and/or mechanical cleaning. Nor is Applicant aware of a device which incorporates all of these desireable features within the relatively small volumetric configuration possible with this invention. Because of the unique combination of the arcuate heating surface of the combustion chamber of the present invention and the location of the burner unit with the associated nozzles, the region containing the burner unit nozzle will be the coolest after combustion ceases. This phenomena is due at least in part to the fact that the heat of radiation emanating from the combustion chamber will radiate at right angles to chords of the arcuate surface and the heat will thus radiate into the region defined by the quadrant diagonally opposite the quadrant defining the combustion chamber of the present invention. In fact Applicant is unaware of any such units available which have the advantages and characteristics described that burn regular fuels such as heating oil and/or gas.

Some inventions related to the instant invention and disclosed in the following United States Patents have been studied. The following is a brief description and discussion of these related inventions.

Juhnke, U.S. Pat. No. 2,056,465 discloses a heater having a cylindrical shape and including a plurality of passageways for air flow therethrough, the passageways allowing contact with the combustion gases in a middle cylinder defined by the inner cylinder wall and an outer wall, the outer wall also in contact with the air and the combustion gases.

Tate, U.S. Pat. No. 483, 819 discloses a hot air furnace which includes a central air passageway which contacts a middle cylinder containing the gases of combustion. The outer wall of the middle cylinder are also in contact with the air, providing two heated air masses.

Rice, U.S. Pat. No. 586,062 discloses a hot air furnace which includes a central jacket having a plurality of pipes having the shpe of the frustum of a cone. These pipes and the outer wall of the jacket radiate heat to the air masses outside the central jacket.

Muckelrath, U.S. Pat. No. 3,388,697 discloses an enlarged air heater for discharging large volumes of heated air toward outdoor work areas and the like comprising upper and lower tubular members within which bypassing non-communicating combustion and air passages are defined for progressively heating the air from the intake end to the discharge thereof. The combustion passage includes a fire tube and an exhaust chamber while the air passage includes a preheating chamber generally coextensive with the exhaust chamber an a final heating chamber generally coextensive with the fire tube.

Whitaker, U.S. Pat. No. 2,494,113 discloses improvements in furnaces used for the heating of buildings. In particular Whitaker teaches the introduction of the flame on a chord, i.e. the flame enters tangentially. He also discusses the notion of providing a spiral baffle plate which in effect directs the gases of combustion in a helical path around a plurality of four or more flues. The air to be heated eners the flues from an intake manifold passes through the flues being heated by the combustion gases and then passes into a hot air manifold at the top of the furnace for distrubtion by conventional means to the spaces to be heated.

Hoesman, U.S. Pat. No. 764,191 discloses a spiral draft configuration. The combustion gases are conveyed through pipes having a spiral arrangement. The spiral arrangement of the pipes induces a spiral draft, which he contends as being very effective in keeping up a rapid combustion. The air being heated ascends through the casing and the coiled pipes and is thoroughly and quickly heat by the hot combustion gases.

SUMMARY OF THE INVENTION

Basically the present invention in it's most simple form of embodiment is directed to a heat exchanger which provides for at least two heat exchange surfaces and which has the combustion of the fuel, which generates the heat, take place within the heat exchanger rather than the heat of combustion being introduced into the exchanger from an external combustion chamber. Additionally, note that the fluid, air in the case of a hot air system, is introduced into the passges where heat exchange will take place, from behind the burner unit, the combustion chamber and in fact behind the flame. The two heat exchange surfaces are defined by an inner wall or inner shell which separates a combustion region or combustion passage and at least one fluid passage defined by the inner shell, and an outer wall or outer shell. The space defined between the inner and outer shells being the combustion region or combustion passage. The combustion chamber is configured to provide for full and efficient fuel combustion without any flat surfaces upon which a flame of combustion could impinge and to cause the region from which the flame emanates to be relatively free of radiant heat from the combustion chamber when combustion ceases. The flame is introduced into the combustion chamber in a direction which results in the flame not impinging onto any substantially flat or planar surface; that is, in a direction substantially perpendicular to, or at an angle of between 90° and 120° to the longer axis of the inner and outer shell. Also the flame emanates from the region which does not receive the radiant heat from the combustion chamber upon cessation of the combustion of the fuel. Because of the nature of the construction, the flame forms into a fan configuration allowing thorough mixture with the combustion air and thus providing for complete and efficient combustion. The structural details and the pressures that are developed within the combustion chamber and the combustion region, cause the flame to spiral along the combustion passage or region enveloping the inner shell. The heat of the combustion gases is given up to the fluid within the cavity formed by the inner shell and the fluid surrounding the outer shell. A truncated and angled section of the inner shell provides the necessary angle to create the proper sized combustion region and it also allows for the proper expansion of the fluid being heated within the passage formed on the interior of the inner shell.

It is a primary object of the present invention to provide a heat exchange device for heating a fluid comprising: an outer shell having an input end and an output end which defines a first cavity; an inner shell within the first cavity which inner shell defines a first fluid passage, and the inner shell has an output section connected by a truncated and angled section to an input section, the other ends of the output section and the input section are attached to an output end securing means and an input end securing means respectively, the securing means are removeably affixed to both the inner and outer shells so as to maintain space relationship between the outer and inner shells; a combustion chamber at the outer shell input end the chamber defined by an arcuate surface of an inner surface of the outer shell and a horizontal and vertical plane, both planes extending from the input end securing means in a direction from the input end toward the output end of the outer shell to about the end of the truncated and angled section attached to the output section and from the arcuate surface to substantially a longer axis of the outer shell; a combustion region defined between the inner surface of the outer shell and an outer surface of the inner shell for containing and directing combustion gases along a path from the combustion chamber to an exhaust gas portal defined by a combustion gas exhaust means positioned substantially at the outer shell output end; and means for introducing a flame from a flame producing assembly into the combustion chamber in a manner to produce a flame having a fan configuration proximate to the arcuate surface and directing the flame at an angle of between 90° and 120° to the longer axis of the outer shell where the longer axis is directed from the input end toward the output end of the outer shell. Typically the fluid being heated is air although water for example could be heated since there is complete lack of communication between the combustion region or passage and the passage or region through which the fluid being heated travels and takes on the heat from the combustion region or passage.

Another primary object of the present invention to provide a heat exchange device having a refractory material placed on the arcuate surface and wherein the outer shell is cylindrically configured and the inner shell output and input sections are cylindrically configured and the truncated and angle section has diameters to mate with the inner shell output and input sections. The truncated and angle section is angled to cause input section of the inner shell to be outside the combustion chamber and the flame. The two end securing means are an output end bell and an input end bell configured to sealingly enclose the combustion gas region and the combustion chamber.

It is another object of the invention to provide a heat exchange device as described above but contained within a heat exchanger housing so as to create a second fluid passage having an inlet and an outlet end. The second fluid passage is in thermal communication with the combustion region and the combustion chamber through the outer shell. The housing also has a means for promoting air flow through the first and second fluid passages and communicates air to be heated with the input section of the inner shell and the inlet end of the second fluid passage. Also there is a means for communicating heated air from the output section of the inner shell and the outlet end of the second fluid passages to the space being heated and the housing contains appropriate peripherally sealing apertures for the combustion gas exhaust means and the flame introducing means such as for example an oil burner assembly.

A further object of the present invention is to provide a heat exchange device wherein the removeably affixed output end and input end securing means are an output end bell and an input end bell configured to sealingly enclose the combustion region and the combustion chamber and the heat exchange device is contained within a tank containing a fluid to be heated. The tank, such as a hot water tank, having a fluid in means, a fluid out means and aperture means for peripherally sealing the exhaust gas means or the exhaust/flue tube and the flame introducing means such as an oil burner unit.

A still further object of the present invention is to provide a heat exchange device which can be easily and completely cleaned by being able to simply remove the input and output end bells or securing means allowing for the removal of the inner shell or 1st fluid passage for cleaning and thereby enhance accessibility to the combustion chamber and combustion region for ease of complete cleaning. Associated with this object is the further object of providing a heat exchange unit capable of burning as the fuel for combustion, waste oil products. Such ability to burn waste oil and waste oil products due in part to the ease of cleaning of the combustion chamber and region and in part due to the geometry of the combustion chamber and the arcuate surface and the chordal direction of the flame.

These and further objects of the present invention will become apparent to those skilled in the art after a study of the present disclosure of the invention and with reference to the accompanying drawings which are a part hereof, wherein like numerals refer to like parts throughout, and in which:

DESCRIPTION OF THE PREFERRED EMBODIMENTS

For the sake of brevity, clearness, and simplicity I shall not describe in detail those familiar parts which have long been constituents of furnaces, hot air systems, fans or air blower assemblies, burner units and their associated components such as pilots, or electrodes and atomizing nozzles, control systems for controlling temperatures of stacks or of the region being heated or of the medium or fluid being heated etc. These constituents or elements of sytems in which the heat exchanger of the instant invention may be used, are well known to those of ordinary skill in the heat exchanger/heater/furnace art. It is also understood that components or constituents such as air filters, fuel oil filters, fuel lines, power supplies and the like will be assumed to be incorporated within the system as is deemed to be appropriate for those systems using the heat exchanger of the present invention. It is also understood that while the present invention may be positioned in various ways such as where the shells or tubes are vertically oriented or horizontally oriented, it may not or should not be used within a system where the exhaust gases output portal is (in a horizontal plane) below the burner assembly mounting tube or means.

Figure 1:
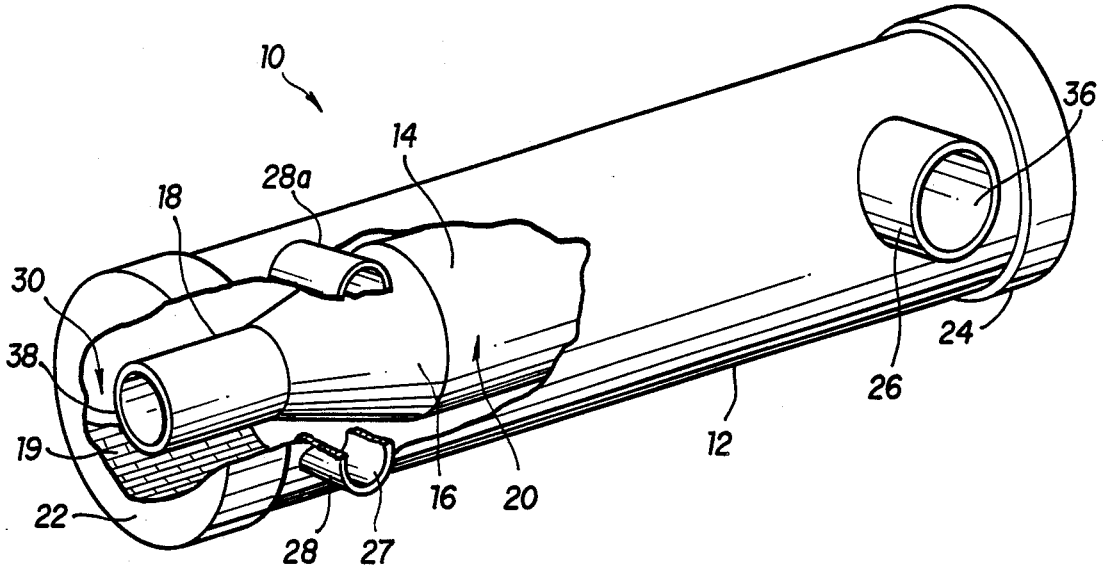
FIG. 1 is a perspective view of the heat exchange device having cutaway sections to illustrate the respective locations of some of the various elements of the instant invention.
Figure 2:
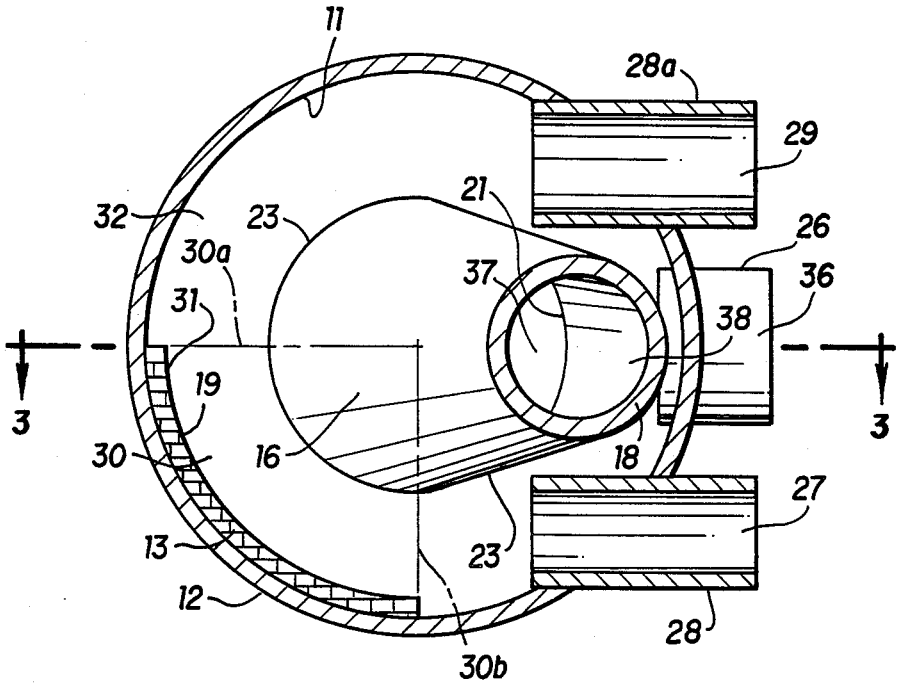
FIG. 2 is an enlarged cross-sectional view taken along a plane passing along line 2—2 in FIG. 1.
Figure 3:
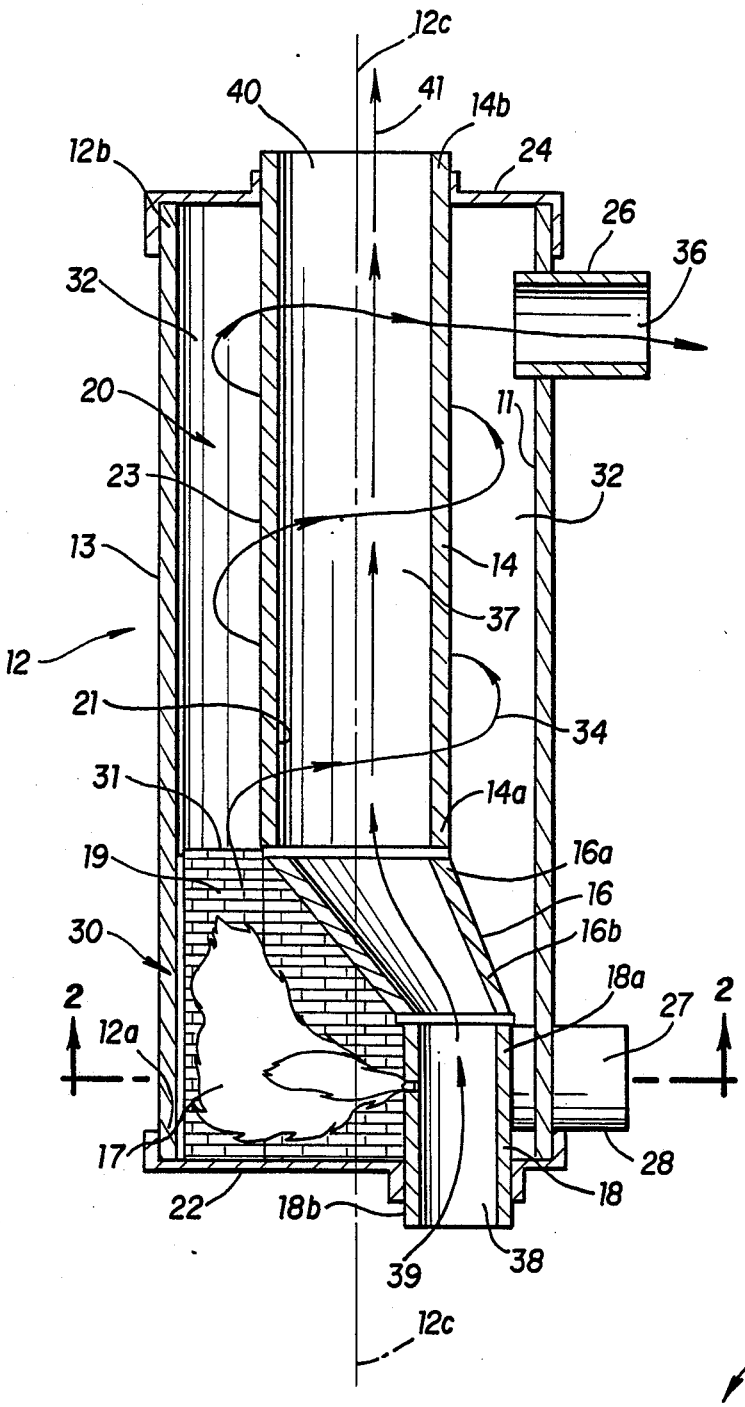
FIG. 3 is an enlarged cross-sectional view taken along a plane passing along line 3—3 in FIG. 1.
Figure 3A:
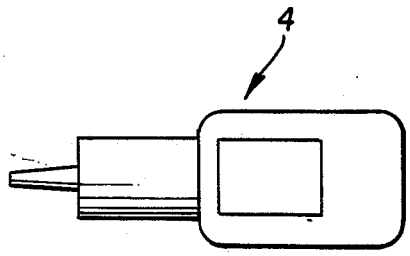
FIG. 3A is a sketch representing a typical burner assembly unit.

Reference is made to FIGS. 1, 2 and 3 collectively in describing the elements and the construction of the instant invention. FIG. 1 is a perspective illustration of the heat exchange device 10 of the invention. FIGS. 2 and 3 are enlarged cross sections of device 10.

The outer shell or outer cylinder 12 is illustrated with a section cut away to show the position of the inner shell 20 and to show the truncated and angled section 16 of the inner shell 20. This cutaway also discloses the combustion chamber 30 and the arcuate surface 19 opposite the burner assembly mounting tube 28. The arcuate surface 19 is covered with a refractory material 31 to reduce, by dispersal, to an acceptable level the concentrated temperature at the outer surface 13 of the outer shell 12 at the input end **12*a*. It should also be noted that the input section 18 of the inner shell is positioned above the burner assembly mounting tube 28 and substantially outside of the combustion chamber 30. The chamber 30 is basically defined by the arcuate surface 19 of an inner surface 11 of the outer shell 12 and a horizontal plane 30*a* and a vertical plane 30*b*, both planes extending from the input end securing means 22 in a direction from the input end 12*a* toward the output end 12*b* of the outer shell 12 to about the end 16*a* of the truncated and angle section 16 and from the arcuate surface 19 to a longer axis 12*c* of the outer shell 12. The truncated and angle section 16 is used to provide the angulation and the size change so that the output section 14 and the input section 18 of the inner shell 20 can be connected to form a first fluid passage 37. The first fluid passage 37 is comprised of the input section 18 the truncated and angled section 16 and the output section 14. The connections are made at one end 14*a* of the output section 14 of the inner shell 20 to one end 16*a* of the truncated and angle section 16 and at one end 18*a* of the input section 18 of the inner shell 20 to the other end 16*b* of the truncated and angled section 16**.

The inner surface 11 of the outer shell 12 and the outer surface 23 of the inner shell 20 cooperate to form a combustion passage or region 32 through which combustion gases travel substantially along path 34 from the combustion chamber 30 to an exhaust or combustion gas portal 36 and thereafter to a chimney or other well known means for venting combustion gases. The combustion exhaust portal 36 is formed by the exhaust tube 26 which is sealingly attached to the outer shell 12 near to the output end **12*b* of the outer shell 12. The output end bell or securing means 24 is configured so that the other end 14*b* of the output section 14 is held in relative position to the output end 12*b* of the outer shell 12 and further provides closure of the combustion region 32 at the output end 12*b*. The input end bell or securing means 22 is configured so that the other end 18*b* of the input section 18 is held in relative position to the input end 12*a* of the outer shell 12 and further provides closure of the combustion region 32 and the combustion chamber 30 at the input end 12*a*. A so-called viewing portal 29 and viewing tube 28*a* are also shown. The viewing portal 29 will become the burner assembly portal 27 if the heat exchanger 10 was rotated along the longer axis. The point being that portals 27 and 29 may be used interchangeably depending only upon which portal is below the input section 18 when the exchanger 10 is essentially positioned in a horizontal attitude. The viewing portal 29 may be appropriately positioned anywhere on the outer shell 12 if rotational symmetry of the exchanger 10** is not of concern.

The operation of and the advantages of the heat exchanger 10 being used as the heat exchanger portion and the combustion chamber portion of a hot air furnace or hot air heater assembly will now be described with reference to FIGS. 1-4.

Figure 4:
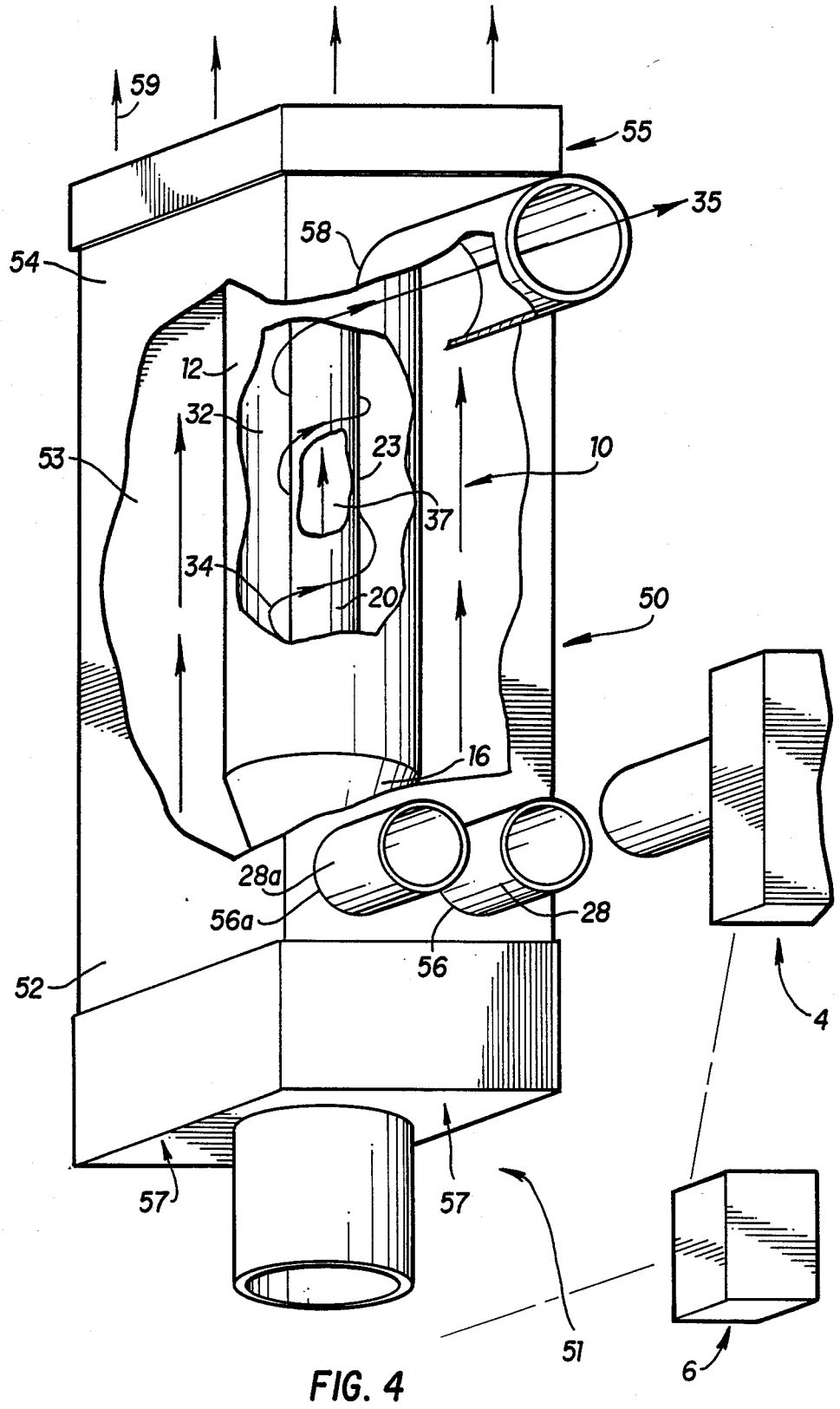
FIG. 4 is a perspective view, with cutaways, of the heat exchange device positioned within a housing which provides for forced airflow across the heat exchange surfaces, for the positioning of a burner assembly and for venting flue gases.

With reference to FIG. 4, it can be seen that the heat exchanger 10 of the present invention including the cylindrically shaped inner and outer shells 20 and 12 respectively, and the input and output end bells 22 and 24 respectively is secured within a heat exchanger housing 50. The housing 50, in combination with, a flow promoting or air blower assembly 51 removebly attached at the housing inlet end 52 and the heated air directing assembly 55 removeably attached at the housing outlet end 54, defining a second (2nd) fluid passage 53. Inlet air 57 is forced or drawn into the inlet end 52 and into the 2nd fluid passage 53 and also into the input portal 38 of the first (1st) fluid passage 37. The inlet air 57 is in heat exchanage communication with the outer surface 13 of outer shell 12 and with the inner surface 21 of inner shell 20 the inlet air 57 thus heated by the combustion gas 35 traveling along path 34 within the combustion region 32 and within the combustion chamber 30. The inlet air 57 is thusly heated and is blown out of or drawn out of the outlet end 54 directed by assembly 55. Assembly 55 may be a filtering and ducting arrangement which directs air 59 into spaces to be heated. The combustion gas is exhausted though portal 36. The exhaust tube 26 passes through the exhaust sealing aperture 58. Both the viewing tube **28*a* and the burner assembly tube 28 pass through sealing apertures 56*a* and 56 respectively. Apertures 56, 56*a* and 58 are all properly located on housing 50**.

In operation, inlet air 57 is heated and discharged as heated air 59. The flame 17 emanates from the burner assembly 4 from a nozzle or jet of ordinary type. The burner assembly 4 is mounted so as to direct the flame 17 at an angle of between 90° and 120° to the longer axis **12*c* of the outer shell 12 where the longer axis 12*c* is directed from the input end 12*a* toward the output end 12*b* of the outer shell 12. The flame 17 travels along a chordal path and enters the combustion chamber 30 indirectly striking the arcuate surface 19 which is normally covered by a refractory material 31. The flame 17 takes on a fan configuration, the flame cone thins down which allows for better mixture with the combustion air. The improved combustion resulting from the firing direction of the burner assembly 4 and the geometry of the combustion chamber 30 having the arcuate surface 19, the refractory 31 and the positioning, out of the combustion chamber 30 of the inner shell 20 due to the truncated and angle section 16 of the inner shell 20, permits a much higher carbon dioxide ($CO_2$) setting without the generation of smoke. It is a very advantageous combination especially when the fuel used in the heat exchange device 10** is waste oil such as engine drain oil and the like.

The operation of and the advantages of the heat exchanger 10 being use as the heat exchanger portion and the combustion chamber portion of a hot water furnace or hot water heater assembly will now be described with refence to FIGS. 1-3 and 5.

Figure 5:
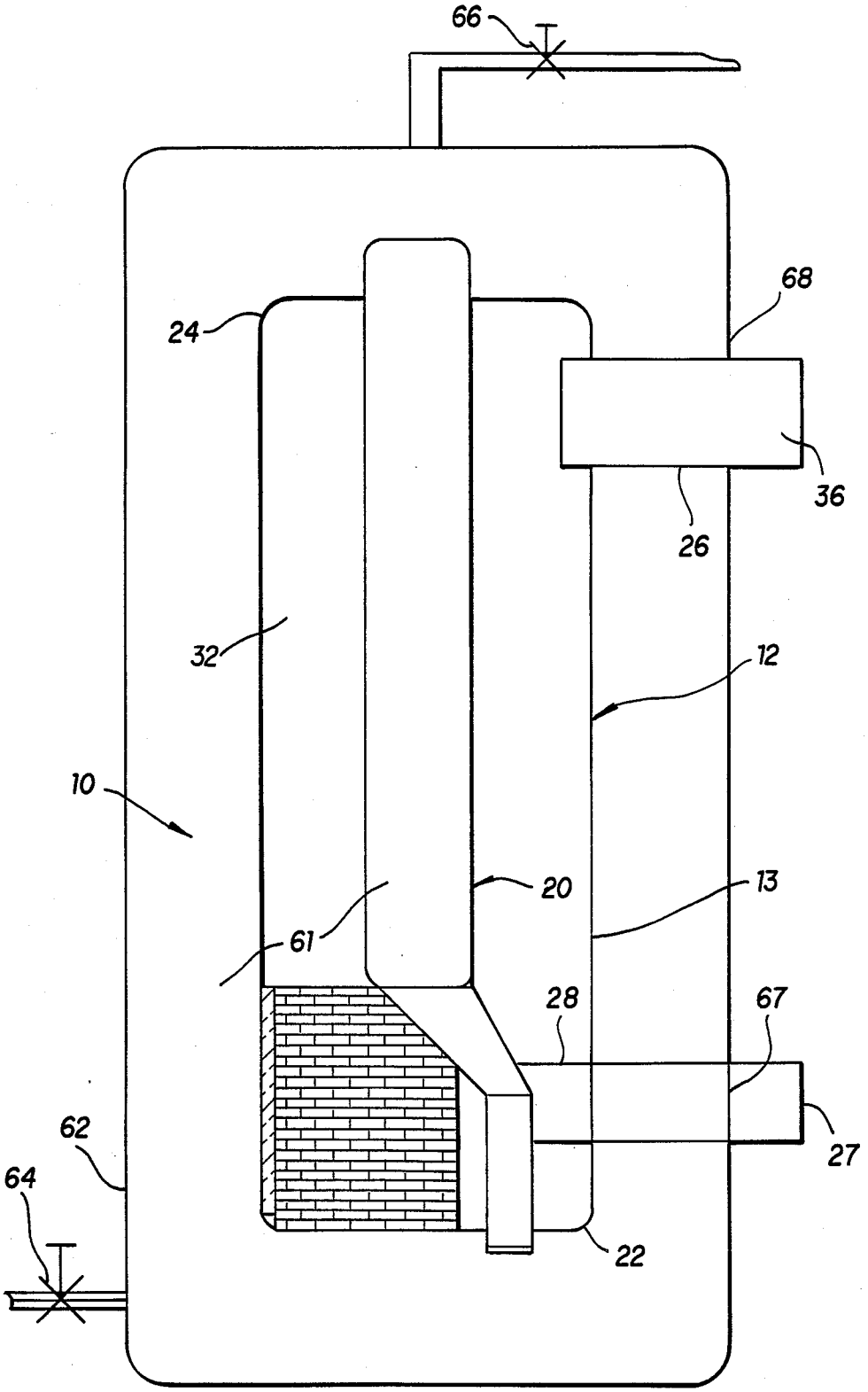
FIG. 5 is an enlarged cross-sectional view, taken along a plane similar to the plane passing along line 3—3 in FIG. 1, of the heat exchange device positioned within a tank type housing which may contain water and which provides the ordinary controls for the heating of water for domestic or other use.

With reference to FIG. 5, it can be seen that the heat exchanger 10 of the present invention including the cylindrically shaped inner and outer shells 20 and 12 respectively, and the input and output end bells 22 and 24 respectively is secured within a tank 62. The tank 62 has an apertures 68, 67 and **67*a* for sealing aroung the exhaust tube 26, the burner assembly mounting tube 28 and the viewing tube 28*a* respectively. The viewing tube 28*a* and the sealing aperture 67*a* are not shown on FIG. 5 because the cross section does not permit. There is also provided a cold water in fitting 64 and a hot water out fitting 66 mounted on tank 62. Provision is made for controlling the temperature of the water 61 in the tank 62. The heat exchange device 10 is mounted in a vertical attitude within tank 62. It is obvious that such a vertical mounting is not necessary. Water need only be made to flow over or surround the surfaces 13 and through the first fluid passage 37. The heat exchanger 10 could also be used in a tankless type hot water heater. The heat exchange device 10 could be mounted within tank 62 in any attitude so long as the burner portal 27 is not above the exhaust portal 36**.

At this time it is important to point out that the truncated and angled section 16 is so designed to not only provide for the connection of the output section 14 to the input section 18 through the truncated and angled section 16 but it also allows for the gradual and controlled expansion of the fluid 39 being heated as it travels from the input portal 38 to the heated fluid 41 at the output portal 40. The angle of the section 16 is also designed to provide for a maximum size combustion chamber 30. The combination of the combustion chamber 30 geometry and the combustion region 32 and the pressures developed within cause the combustion gases 35 to follow a path 34 which is substantially helical and provides for efficient thermal energy transfer into the first fluid passage 37 and into the second fluid passage 53 of FIG. 4 or into the fluid 61 of FIG. 5 that is flowing over and in thermal contact with the outside surface 13 and the fluid 61 of FIG. 5 that is flowing over and in thermal contact with the inner surface 21.

A further advantageous feature of the invention is the ease of cleaning of the combustion chamber 30 and the combustion region 32. The end bells 22 and 24 are removeably affixed to the input and the output ends **12*a* and 12*b* of the outer shell 12. These end bells 22 and 24 are designed to effectively seal around the ends 12*b*, 14*b*, 12*a* and 18*b* thereby creating the combustion region 32 and chamber 30. Only the burner assembly tube 28 the viewing tube 28*a* and the combustion exhaust tube 26 all mounted onto outer shell 12 create apertures or portals 27, 29 and 36 which are in flame 17 and combustion gas 35 communication with the combustion passage or region 32. The end bells 22 and 24 are designed for easy removal. When the end bells 22 and 24 are removed, the inner shell 20 can be taken from the first cavity 12*c* within the outer shell 12 and the combustion chamber 30 and the associated arcuate surface 19 with refractory 31 can be easily and quickly cleaned. Likewise the outer surface 23 and in inner surface 11 of the inner shell 20 and the outer shell 12** can be easily accessed and cleaned.

The space which is referred to as the first cavity **12*c* is not identified in the drawings because the so-called first cavity 12*c* becomes the combustion passage or region 32 after the inner shell 20 is positioned within the first cavity 12*c***.

Ordinary and conventional burner assemblies 4, control system 6, heated air directing assemblies 55 and an air blower assembly 51, all of which are pictorially illustrated in FIGS. 3, 4 and 5, are used with the hot air heater assembly.

It is understood that the device as illustrated and described herein may have different dimensions and variations of the illustrated basic geometry and may have different attitudes within the system wherein the instant device is being used. It is also understood that the device can be scaled up or down to provide for more or less BTU's of heat respectively.

It is also thought that the heat exchange device of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A heat exchange device for heating a fluid comprising an outer shell having an input end and an output end defining a first cavity therein; an inner shell within said first a cavity said inner shell defining a first fluid passage therein, said inner shell having an output section connected at one end to one end of a truncated and angled section, the other end of said truncated and angled section connected to one end of an input section the other ends of the output section and the input section being attached to a removeably affixed output end securing means and a removeably affixed input end securing means respectively, said securing means maintaining said space relationship between said outer shell and said inner shell; a combustion chamber at said outer shell input end said chamber defined by an arcuate surface of an inner surface of said outer shell and a horizontal and vertical plane, both planes extending from said input end securing means in a direction from the input end toward the output end, to about the one end of said truncated and angled section and from said arcuate surface to substantially a longer axis of said outer shell; a combustion region defined between said inner surface of said outer shell and an outer surface of said inner shell for containing and directing combustion gases along a path from said combustion chamber to an exhaust gas portal defined by a combustion gas exhaust means positioned substantially at said outer shell output end, said combustion gas path substantially enveloping said outer surface of said inner shell; and means for introducing a flame from a flame producing assembly into said combustion chamber in a manner to produce a flame having a fan configuration proximate to said arcuate surface and directing said flame at an angle of between about 90° and 120° to said longer axis of the outer shell said longer axis directed from the input end toward the output end of said outer shell.

2. The heat exchange device according to claim 1 wherein said fluid being heated is air.

3. The heat exchange device according to claim 2 further comprising a heat exchanger housing such that said heat exchange device is contained within said heat exchanger housing so as to create a second fluid passage having an inlet and an outlet end said second fluid passage in thermal communication with said combustion region and said combustion chamber through said outer shell, said housing having a means for promoting air flow through said first and said second fluid passages and communicating air to be heated with the input section of said inner shell and the inlet end of said second fluid passage and a means for communicating heated air from the output section of said inner shell and the outlet end of said second fluid passages to the space being heated and said housing containing appropriate peripherally sealing apertures for said combustion gas exhaust means and said flame introducing means.

4. The heat exchange device according to claim 2 further comprising a refractory material placed on said arcuate surface.

5. The heat exchange device according to claim 4 wherein said outer shell, said inner shell output section and said inner shell input section are cylindrically configured and said one end and said other end of the truncated and angle section have diameters to mate with said one end of the inner shell output section and said one end of the inner shell input section respectively and is angled to cause said input section of said inner shell to be outside said combustion chamber and said flame.

6. The heat exchange device according to claim 5 wherein said removeably affixed output end securing means and said removeably affixed input end securing means are an output end bell and an input end bell configured to sealingly enclose said combustion region and said combustion chamber.

7. The heat exchange device according to claim 6 wherein said combustion gas path is substantially a helical path.

8. The heat exchange device according to claim 7 further comprising a means for viewing said flame in said combustion chamber and said means for viewing sealingly attached to said outer shell, and wherein said flame producing assembly is an oil burner unit.

9. The heat exchange device according to claim 7 further comprising a heat exchanger housing such that said heat exchange device is contained within said heat exchanger housing so as to create a second fluid passage having an inlet and an outlet end said second fluid passage in thermal communication with said combustion region and said combustion chamber through said outer shell, said housing having a means for promoting air flow through said first and said second fluid passages and communicating, shell and the and communicating heated air from the output section of said inner shell and the outlet end of said second fluid passages to the space being heated and said housing containing aperture means for peripherally sealing said combustion gas exhaust means and said flame introducing means.

10. The heat exchange device according to claim 1 wherein said removeably affixed output end securing means and said removeably affixed input end securing means are an output end bell and an input end bell configured to sealingly enclose said combustion gas region and said combustion chamber and said heat exchange device is contained within a tank containing a fluid to be heated, said tank having a fluid in means, a fluid out means, aperture means for peripherally sealing said exhaust gas means and an aperture means for peripherally sealing said flame introducing means.

* * * * *